US009593687B2

(12) United States Patent
Iwamoto et al.

(10) Patent No.: US 9,593,687 B2
(45) Date of Patent: Mar. 14, 2017

(54) CEILING FAN

(75) Inventors: Kiyohiko Iwamoto, Aichi (JP); Hiroyuki Kuramochi, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 599 days.

(21) Appl. No.: 13/993,075

(22) PCT Filed: Dec. 14, 2011

(86) PCT No.: PCT/JP2011/006975
§ 371 (c)(1),
(2), (4) Date: Jun. 11, 2013

(87) PCT Pub. No.: WO2012/093445
PCT Pub. Date: Jul. 12, 2012

(65) Prior Publication Data

US 2013/0280077 A1 Oct. 24, 2013

(30) Foreign Application Priority Data

Jan. 7, 2011 (JP) ..... 2011-001741

(51) Int. Cl.
*F04D 19/00* (2006.01)
*F04D 25/08* (2006.01)
*F04D 29/32* (2006.01)

(52) U.S. Cl.
CPC ..... *F04D 19/002* (2013.01); *F04D 25/088* (2013.01); *F04D 29/329* (2013.01)

(58) Field of Classification Search
CPC ..... F04D 29/00; F04D 29/005; F04D 29/329; F04D 19/002; F04D 25/088; F04D 19/00
USPC ..... 416/5, 210 R, 214 R
See application file for complete search history.

(56) References Cited

U.S. PATENT DOCUMENTS 4,634,345 A * 1/1987 Stanek ..... F24F 13/32 248/343
5,883,449 A * 3/1999 Mehta ..... F04D 25/082 310/417
5,975,847 A * 11/1999 Yu ..... F04D 25/088 416/5

(Continued)

FOREIGN PATENT DOCUMENTS

CN 101946093 1/2011
GB 478417 1/1938

(Continued)

OTHER PUBLICATIONS

English Translation of Chinese Search Report dated Apr. 15, 2015 for the related Chinese Patent Application No. 201180064263.3.

(Continued)

*Primary Examiner* — Gregory Anderson
*Assistant Examiner* — Maxime Adjagbe
(74) *Attorney, Agent, or Firm* — Panasonic IP Management; Kerry S. Culpepper

(57) ABSTRACT

A ceiling fan includes a suspending unit and a ceiling fan body. The ceiling fan body includes a shaft; a motor; a plurality of blades; an upper body cover having a first opening, at a central part, for passing the shaft therethrough, and a second opening outside the first opening; and a lower body cover. The upper body cover rotates with the blades and has a first wall standing vertically between the first opening and the second opening.

10 Claims, 3 Drawing Sheets

(56) References Cited

U.S. PATENT DOCUMENTS

| | | | | |
|---|---|---|---|---|
| 6,022,189 | A * | 2/2000 | Yu | F04D 25/088 416/170 R |
| 2005/0207140 | A1* | 9/2005 | Srass | F04D 25/088 362/96 |
| 2011/0002783 | A1 | 1/2011 | Yamamoto et al. | |
| 2011/0274561 | A1 | 11/2011 | Kobayashi et al. | |
| 2013/0045103 | A1 | 2/2013 | Iwamoto et al. | |

FOREIGN PATENT DOCUMENTS

| | | | |
|---|---|---|---|
| JP | 61-078293 | U | 4/1986 |
| JP | 61-078300 | U | 4/1986 |
| JP | 61-78293 | U | 5/1986 |
| JP | 61-078293 | U | 5/1986 |
| JP | 61-78300 | U | 5/1986 |
| JP | 61-078300 | U | 5/1986 |
| JP | 63-17892 | U | 2/1988 |
| JP | 2008-121552 | | 5/2008 |
| JP | 2010-169001 | | 8/2010 |
| WO | 2009/110201 | | 9/2009 |
| WO | 2011/148593 | | 12/2011 |

OTHER PUBLICATIONS

International Search Report of PCT Application No. PCT/JP2011/006975 dated Mar. 19, 2012.

Singaporean Search Report dated Jun. 13, 2014 for the related Singaporean Patent Application No. 201305194-1.

* cited by examiner

CEILING FAN

CROSS-REFERENCE TO RELATED APPLICATIONS

The present application is a national phase application of international application PCT/JP2011/006975 filed on Dec. 14, 2011, which claims the benefit of foreign priority to Japanese patent application 2011-001741 filed on Jan. 7, 2011, the contents of which are incorporated herein by reference.

TECHNICAL FIELD

The present invention relates to a ceiling fan.

BACKGROUND ART

Conventional ceiling fans include a suspending unit and a ceiling fan body. The ceiling fan body includes a shaft, a motor, a plurality of blades, an upper body cover, and a lower body cover. The upper body cover has at its central part a first opening for passing a shaft therethrough, and second openings outside the first opening. The suspending unit is fixed to the ceiling. The ceiling fan body is suspended at the shaft by the suspending unit. The motor is fixed to the bottom of the shaft. The blades are attached to the motor. The upper body cover is disposed over the motor. The lower body cover is disposed under the motor. One such ceiling fan is disclosed in a Patent Literature shown below.

A task of the conventional ceiling fan is to improve safety, which is performed in the following way. A conventional ceiling fan has openings (a first opening and second openings) in the upper body cover in order to reduce a temperature increase in the motor. When the motor is heated, the heat causes an upward current, which is discharged through the openings of the upper body cover, thereby reducing the temperature increase in the motor.

CITATION LIST

Patent Literature

Patent Literature 1: Japanese Patent Unexamined Publication No. 2010-169001

SUMMARY OF THE INVENTION

However, in the case that water is spilled in an upstairs room in an apartment or other multi-family building, this may cause a short circuit or current leakage in the ceiling fan in the downstairs room. Specifically, the water spilled in the upstairs room may run down along the suspending unit of the ceiling fan in the downstairs room, and enter the motor through the openings of the upper body cover.

The ceiling fan of the present invention includes a suspending unit fixed to a ceiling; and a ceiling fan body suspended by the suspending unit. The ceiling fan body includes a shaft configured to be suspended by the suspending unit; a motor fixed at the bottom of the shaft; a plurality of blades attached to the motor; an upper body cover disposed on the upper surface of the motor; and a lower body cover covering the motor. The upper body cover has a first opening, at a central part, for passing the shaft therethrough; and a second opening outside the first opening. The upper body cover rotates with the blades and has a first wall standing vertically between the first opening and the second opening.

With this configuration, even if water droplets from the ceiling fall in between the first opening and the first wall, the water droplets are forced outward along the upper surface of the upper body cover by the centrifugal force generated by the rotation of the upper body cover, and then collide with the first wall. Then, the water droplets are propelled up the first wall and splash outside the upper body cover. This reduces the amount of water that enters the motor through the second openings so as to prevent a short circuit, thereby improving safety.

DESCRIPTION OF EMBODIMENT

An exemplary embodiment of the present invention will now be described with reference to drawings.

Exemplary Embodiment

Figure 1:
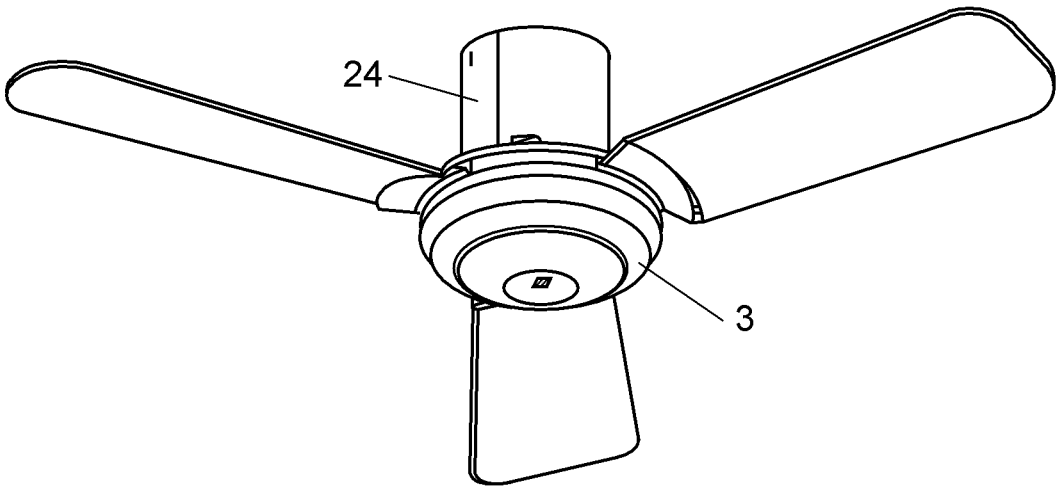
FIG. 1 is a schematic diagram of a ceiling fan according to an exemplary embodiment of the present invention.

FIG. 1 is a schematic diagram of a ceiling fan according to an exemplary embodiment of the present invention. As shown in FIG. 1, the ceiling fan of the present embodiment includes ceiling fan body 3 and cylindrical unit 24 covering the top portion of ceiling fan body 3.

Figure 2:
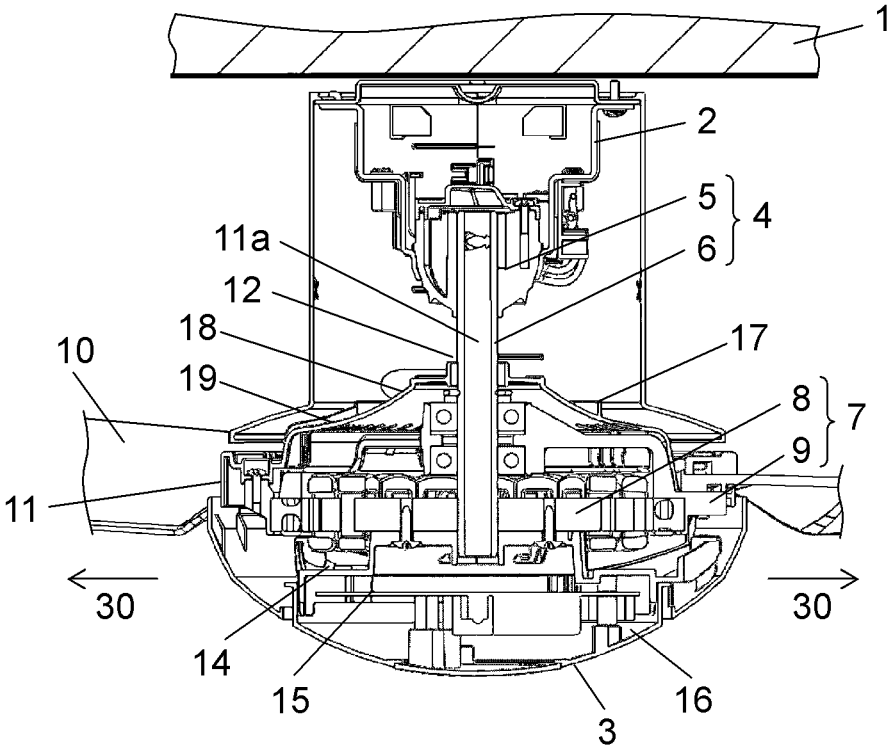
FIG. 2 shows the inside of the ceiling fan.

FIG. 2 shows the inside of the ceiling fan of the present invention. As shown in FIG. 2, the ceiling fan includes suspending unit 2 fixed to ceiling 1, and ceiling fan body 3 suspended by suspending unit 2. Ceiling fan body 3 includes shaft 4, motor 7, blades 10, upper body cover 11, and lower body cover 16. Shaft 4 is disposed at the top portion of ceiling fan body 3 in such a manner as to be suspended by suspending unit 2. Shaft 4 includes joint 5 directly hung on suspending unit 2, and cylindrical shaft portion 6 provided under joint 5.

Motor 7 is fixed at the bottom of shaft portion 6. Motor 7 includes disk-shaped stator 8 fixed to the bottom of shaft portion 6, and ring-shaped rotor 9, which rotates around stator 8. Blades 10 extend from around the periphery of rotor 9 in outward horizontal direction 30.

Figure 3:
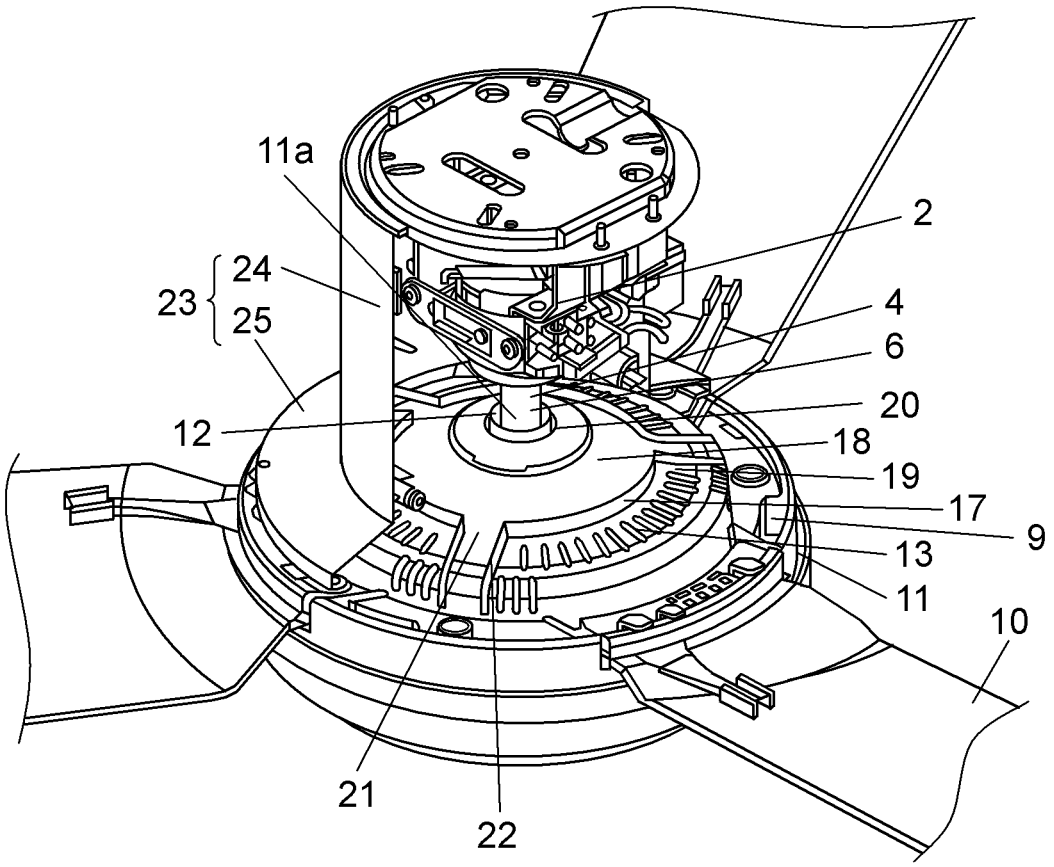
FIG. 3 is an obliquely upward view of the ceiling fan from which an outer cover has been partially removed.

FIG. 3 is an obliquely upward view of the ceiling fan according to the exemplary embodiment of the present invention from which an outer cover has been partially removed. As shown in FIG. 3, bowl-shaped upper body cover 11 having an open bottom is disposed on the upper surface of rotor 9. Upper body cover 11 has, at central part 11*a*, circular first opening 12 for passing shaft portion 6 therethrough. Upper body cover 11 further has a plurality of second openings 13 outside first opening 12. Second openings 13 are long holes extending outward.

As shown in FIG. 2, ceiling fan body 3 further includes circuit board holding cover 14 at the bottom of stator 8, and circuit board 15 under stator 8. Circuit board holding cover 14 is bowl-shaped with an open bottom and is fixed to the bottom surface of stator 8. Circuit board 15 is fixed inside circuit board holding cover 14. Lower body cover 16 is bowl-shaped with an open top and is fixed to cover circuit board holding cover 14 and circuit board 15 from below. The periphery of lower body cover 16 is located outside the periphery of upper body cover 11. When the ceiling fan having the above structure is switched on, rotor 9 of motor 7 rotates, making blades 10 and upper body cover 11 rotate.

As shown in FIG. 3, the ceiling fan of the present exemplary embodiment is characterized in that upper body cover 11 rotates with blades 10, and that upper body cover 11 includes cylindrical first wall 17 standing vertically between first opening 12 and second openings 13.

Even if water droplets fall from ceiling 1 between first opening 12 and first wall 17, the water droplets are forced outward along the upper surface of upper body cover 11 by the centrifugal force generated by the rotation of upper body cover 11. Then, the water drops move upward along first wall 17 by the centrifugal force. As shown in FIG. 2, first wall 17 is a cylindrical plate protruding vertically from upper body cover and has a top edge, and the water droplets splash outside upper body cover 11 from the top edge by the centrifugal force.

As shown in FIGS. 2 and 3, upper body cover 11 has first inclined surface 18 between first opening 12 and first wall 17, first inclined surface 18 inclining downward in an outward direction. More specifically, upper body cover 11 has ring-shaped first inclined surface 18 inclined downward toward first wall 17 from around the periphery of first opening 12.

Hence, when water droplets fall on first inclined surface 18 from ceiling 1, first inclined surface 18 facilitates them to be discharged to the outside by the rotation of upper body cover 11. Thus, the water droplets splash outside upper body cover 11 so as to reduce the amount of water that enters motor 7 through second openings 13, thereby improving safety.

As shown in FIG. 3, first wall 17 adjoins second openings 13. The short distance between first wall 17 and second openings 13 allows the water droplets that have been propelled up first wall 17 by the centrifugal force to easily be propelled over second openings 13 and to splash outside upper body cover 11.

As shown in FIG. 3, upper body cover 11 further has second inclined surface 19 outside first wall 17, second inclined surface 19 inclining downward in the outward direction from first wall 17. Second openings 13 are formed in second inclined surface 19. More specifically, second openings 13 are formed in the direction in which second inclined surface 19 is inclined downward.

Hence, when water droplets fall between second openings 13 on second inclined surface 19 from ceiling 1, second inclined surface 19 facilitates them to be discharged to the outside by the rotation of upper body cover 11. Thus, water droplets splash outside upper body cover 11 so as to reduce the amount of water that enters motor 7 through second openings 13.

As shown in FIG. 3, upper body cover 11 further includes cylindrical second wall 20 standing around shaft 4 along the periphery of first opening 12. Hence, even if water droplets fall near the outside of second wall 20 from ceiling 1 and then splash toward first opening 12, second wall 20 reduces the amount of water that enters motor 7 through first opening 12.

As shown in FIG. 3, first wall 17 has a plurality of grooves 21. Each groove 21 includes guide units 22 formed on second inclined surface 19. More specifically, first wall 17 includes grooves 21 which communicating between first inclined surface 18 and the outside of second openings 13 by way of guide units 22. Grooves 21 are where first wall 17 is not formed. Guide units 22 are flat plates standing vertically and located between second openings 13. Guide units 22 decrease in height in the outward direction.

Hence, the water droplets that have fallen between first opening 12 and first wall 17 from ceiling 1 but have not been propelled up first wall 17 are forced into grooves 21 along first wall 17 by the centrifugal force. Then, the water droplets splash from grooves 21 to the outside of second openings 13 along guide units 22. This reduces the amount of water that enters motor 7 through second openings 13.

As shown in FIG. 3, the ceiling fan of the present invention further includes outer cover 23, which covers suspending unit 2, shaft 4, and upper body cover 11. Outer cover 23 includes cylindrical unit 24 and flange 25. Cylindrical unit 24 is fixed around the periphery of suspending unit 2. Flange 25 extends outward and obliquely downward from the bottom end of cylindrical unit 24. Cylindrical unit 24 is disposed outside second openings 13. In other words, outer cover 23 covers the periphery of suspending unit 2 and upper body cover 11.

As described above, the ceiling fan of the present invention includes outer cover 23, which prevents the water droplets fallen on the outer peripheral surface of outer cover 23 from ceiling 1 from entering motor 7. Cylindrical unit 24 does not rotate and is disposed outside second openings 13. Hence, the water droplets that have fallen between first opening 12 and first wall 17 from ceiling 1 and then splashed outside upper body cover 11 adhere to the inner circumference surface of outer cover 23. Then, the water droplets run along the inner circumference surface of outer cover 23 and the bottom surface of flange 25, and finally run down to the outside of second openings 13. This reduces the amount of water that enters motor 7 through second openings 13.

Therefore, the present disclosure concerns a ceiling fan body 3 for a ceiling fan, the ceiling fan body includes an upper body cover 11 and a lower body cover 16. The upper body cover 11 includes a central hole 12 configured to receive a shaft portion 6 which is mechanically engaged with a motor 7 including a stator 8 and a rotor 9 rotating around the stator, the upper body 11 disposed on an upper surface of the rotor 9. The upper body cover 11 includes a plurality of slits 13 disposed radially in an outer periphery of the central hole for radiating heat. The upper body cover 11 includes a wall portion 17 disposed radially between the plurality of slits 13 and the central hole 12, the wall portion 17 configured to substantially prevent fluid from entering the plurality of slits while the rotor 9 rotates around the stator. The upper body cover 11 further includes a second wall portion 20 disposed radially along a periphery of the central hole 12. The wall portion 17 further includes a plurality of guide units arranged to guide the fluid from the wall portion 17 out of the ceiling fan body.

INDUSTRIAL APPLICABILITY

As described above, the ceiling fan of the present invention is expected to be suitable for household and office use

REFERENCE MARKS IN THE DRAWINGS

1 ceiling
2 suspending unit
3 ceiling fan body
4 shaft
5 joint
6 shaft portion
7 motor
8 stator

9 rotor
10 blade
11 upper body cover
11*a* central part
12 first opening
13 second opening
14 circuit board holding cover
15 circuit board
16 lower body cover
17 first wall
18 first inclined surface
19 second inclined surface
20 second wall
21 groove
22 guide unit
23 outer cover
24 cylindrical unit
25 flange
30 outward horizontal direction

The invention claimed is:

1. A ceiling fan comprising:
a suspending unit fixed to a ceiling; and
a ceiling fan body suspended by the suspending unit, the ceiling fan body including:
a shaft configured to be suspended by the suspending unit;
a motor fixed at a bottom of the shaft;
a plurality of blades attached to the motor;
an upper body cover disposed on an upper surface of the motor; and
a lower body cover covering the motor,
the upper body cover having a first opening at a central part for passing the shaft therethrough, and a second opening outside the first opening,
wherein the upper body cover rotates with the blades and has a first wall protruding vertically from the upper body cover between the first opening and the second opening, the first wall being a cylindrical plate and having a top edge,
wherein the upper body cover has a first inclined surface inclining downward in an outward direction between the first opening and the first wall.

2. The ceiling fan of claim 1, wherein
the first wall is adjacent to the second opening.

3. The ceiling fan of claim 1, wherein
the upper body cover further has a second inclined surface outside the first wall, the second inclined surface inclining downward in the outward direction from the first wall; and
the second opening is formed in the second inclined surface.

4. The ceiling fan of claim 1, wherein
the upper body cover further includes a second wall standing around the shaft along a periphery of the first opening.

5. The ceiling fan of claim 1, further comprising:
an outer cover covering a periphery of the suspending unit and the upper body cover.

6. The ceiling fan of claim 1, wherein
the first wall includes a groove communicating between the first inclined surface and an outside of the second opening by way of a guide unit located between the second opening and another of the second opening.

7. A ceiling fan body for a ceiling fan, the ceiling fan body comprising:
an upper body cover; and
a lower body cover,
wherein the upper body cover includes a central hole configured to receive a shaft portion which is mechanically engaged with a motor, the motor including a stator and a rotor rotating around the stator, the upper body cover disposed on an upper surface of the rotor,
wherein the upper body cover includes a plurality of slits disposed radially in an outer periphery of the central hole for radiating heat, and
wherein the upper body cover includes a wall portion disposed between the plurality of slits and the central hole, the wall portion including a plurality of arc-shaped portions and guide unit portions, the wall portion being a cylindrical plate protruding vertically from the upper body cover and having a top edge,
the upper body cover further includes a first inclined surface inclining downward in an outward direction from the central hole to the wall portion, and a plurality of grooves, each of the plurality of grooves located between adjacent guide unit portions and where the wall portion is not formed.

8. The ceiling fan body of claim 7, wherein the upper body cover further includes a second wall portion disposed along a periphery of the central hole.

9. The ceiling fan of claim 4, wherein
the upper body cover has a first inclined surface inclining downward in an outward direction from the first opening to the first wall.

10. A ceiling fan body for a ceiling fan, the ceiling fan body comprising:
an upper body cover; and
a lower body cover,
wherein the upper body cover includes a central hole configured to receive a shaft portion which is mechanically engaged with a motor, the motor including a stator and a rotor rotating around the stator, the upper body cover disposed on an upper surface of the rotor,
wherein the upper body cover includes a plurality of slits disposed radially in an outer periphery of the central hole for radiating heat, and
wherein the upper body cover includes a wall portion disposed between the plurality of slits and the central hole, the wall portion including a plurality of arc-shaped portions and guide unit portions, the wall portion being a cylindrical plate protruding vertically from the upper body cover and has a top edge,
the upper body cover further includes a first inclined surface inclining downward in an outward direction from the central hole to the wall portion and a second surface outside the wall portion, the plurality of slits formed in the second surface.

* * * * *